United States Patent [19]

Grabbe

[11] Patent Number: 4,743,203

[45] Date of Patent: May 10, 1988

[54] CAMMING MEANS FOR USE WITH A LOW INSERTION FORCE CONNECTOR

[75] Inventor: Dimitry G. Grabbe, Middletown, Pa.

[73] Assignee: AMP Incorporated, Harrisburg, Pa.

[21] Appl. No.: 47,232

[22] Filed: May 7, 1987

[51] Int. Cl.[4] ..... H01R 9/09

[52] U.S. Cl. ..... 439/260; 439/267

[58] Field of Search ..... 439/259, 260, 266, 267

[56] References Cited

U.S. PATENT DOCUMENTS

| | | | |
|---|---|---|---|
| 3,944,311 | 3/1976 | Sprenkle et al. | 339/45 M |
| 4,169,644 | 10/1979 | Bonhomme | 439/260 |
| 4,179,177 | 12/1979 | Lapraik | 339/74 R |
| 4,196,955 | 4/1980 | Anhalt | 339/74 R |
| 4,390,224 | 6/1983 | Showman et al. | 439/260 |
| 4,470,653 | 9/1984 | Coller et al. | 439/266 |
| 4,480,884 | 11/1984 | Babuka et al. | 339/17 L |
| 4,575,171 | 3/1986 | Igarashi et al. | 439/267 |
| 4,636,021 | 1/1987 | Bobb et al. | 339/75 MP |

OTHER PUBLICATIONS

IBM Technical Disclosure Bulletin, vol. 14, No. 9, Feb. 1972.

*Primary Examiner*—John McQuade

*Attorney, Agent, or Firm*—Bruce J. Wolstoncroft

[57] ABSTRACT

The present invention relates to a camming means for a zero insertion force connector or the like. The camming means has cam profiles which extend through an extension of the housing of the connector. The cam profiles are configured to distribute the forces to the extension of the housing, thereby eliminating the forces applied the cam slides which are perpendicular to the longitudinal axis of the cam slides. The positioning of the cam profiles relative to each other ensures that the camming means can be used in connectors in which space is at a premium.

4 Claims, 3 Drawing Sheets

CAMMING MEANS FOR USE WITH A LOW INSERTION FORCE CONNECTOR

FIELD OF THE INVENTION

The invention is directed to an improved camming means for use in a zero insertion force connector or the like. In particular the invention is directed to positioning cam profiles in the housing to provide for effective operation of the cam means.

BACKGROUND OF THE INVENTION

It is well known in the electronic computer art that a computer system includes at least one printed circuit board commonly referred to as a mother board. In many applications, a plurality of daughter boards are connected to the mother board. Various connectors have been utilized in order to provide a reliable connection between the mother board and daughter boards. These connectors are generally referred to as edge connectors because they connect conductive areas located on the edge of the daughter boards with the mother board.

A preferred type of edge connector is the zero insertion force (ZIF) connector. This type of connector allows for easy insertion and removal of the daughter board from the mother board. This is an extremely important result, because it allows for easy replacement of defective parts of the system, which translates into a much more cost effective system.

A typical ZIF connector plugs into plated through holes of the mother board. Opposed rows of spring contacts, which extend away from the surface of the mother board, can then be cammed from an open position to a closed position. The open position allows the daughter board to be inserted into the connector under zero insertion force conditions, i.e. the conductive areas of the daughter board do not engage the contacts of the connector. This type of connector is essential when a daughter board, having numerous conductive areas, is to be inserted into a corresponding connector having numerous contact elements. Without a ZIF connector, it would be difficult to insert the daughter board into the connector without damaging the conductive areas of the daughter board or the contacts of the connector. Once insertion is complete the contacts are moved to the closed position, in which the contacts are in electrical engagement with the conductive areas of the daughter board.

The spring contacts are moved from the open position to the closed position by some type of camming means which is movable from a first position to a second position. One type of commonly used camming means is referred to as a linear cam. In a linear cam, each cam member is defined by a single plane. Therefore, as each cam member is moved from the first position to the second position there is no movement of that cam member outside of its original plane. There are many types of linear cams available in the market place today.

U.S. Pat. No. 4,636,021 discloses and describes a high density zero insertion force (ZIF) connector which utilizes a linear cam to move a portion of the housing of the connector, which in turn moves the contacts between the open position and the closed position. However, as the number of contacts needed is increased, the force required to move the contacts between the open position and the closed position is likewise increased.

The result of the increase force has been the failure of many of the camming means. This is a direct result of the pivot between the cam lever and the cam arm having a vertical, as well as a horizontal force applied thereto.

U.S. Pat. No. 4,480,884 describes a linear cam which has slots provided in the cam members. These slots cooperate with pins to alleviate some of the forces on the actuator lever. Consequently, as the forces are distributed, the failure rate of the camming means is decreased. However, this type of camming means requires that the cam members be relatively wide in comparison the the connector, to ensure proper operation of the camming means. The slots must be of adequate length to ensure that vertical movement is not restricted. Consequently, such cam members are not practical when space is at a premium. To provide a narrow cam member with slots provided therein would result in failure of the cam member due to inadequate strength, as well as restricted movement.

SUMMARY OF THE INVENTION

An objective of the present invention is to provide an improved camming means which can operate, without failure, a ZIF connector having many contacts provided therein. In order to do this, cam profiles are provided in the housing of the connector to provide the support necessary to effectively distribute the forces so that failure of the camming means does not occur.

It is a further objective of this invention to provide an effective camming means which occupies only a relatively small space of the overall connector. This is important as miniaturization of computers and the like occurs.

A further objective of this invention is to provide a camming means which minimizes the pivot points required for operation. The fewer moving parts involved, the fewer places where problems can occur.

To obtain these objectives a camming means for use with a low insertion force connector is provided. The connector having a housing with terminals provided therein, the terminals being moveable from an open position to a closed position.

The camming means having a first slot means provided in a support member. The support member is attached to the housing of the connector. A second slot means is also provided in the housing, proximate the first slot means.

Actuating means cooperate with the support means. The actuating means have opening means which extend therethrough. The first opening means being in alignment with the first slot means, and the second opening means being in alignment with the second slot means. The actuating means is movable between a closed position and an open position.

Cam slide means extend through the slot means, such that an end of each cam slide means is positioned proximate the actuating means. Openings are provided in the ends, the openings being in alignment with the second opening means. The cam slide means is movable between a second and a first position which correspond to the closed and open position of the actuating means.

Pins are provided to act as cam followers. A first pin extends through the first slot means and the first opening means, and is maintained therein. A second pin extends through the second slot means, the second opening means, and the opening of the cam slide means, and is maintained therein.

DETAILED DESCRIPTION OF THE INVENTION

Figure 2:
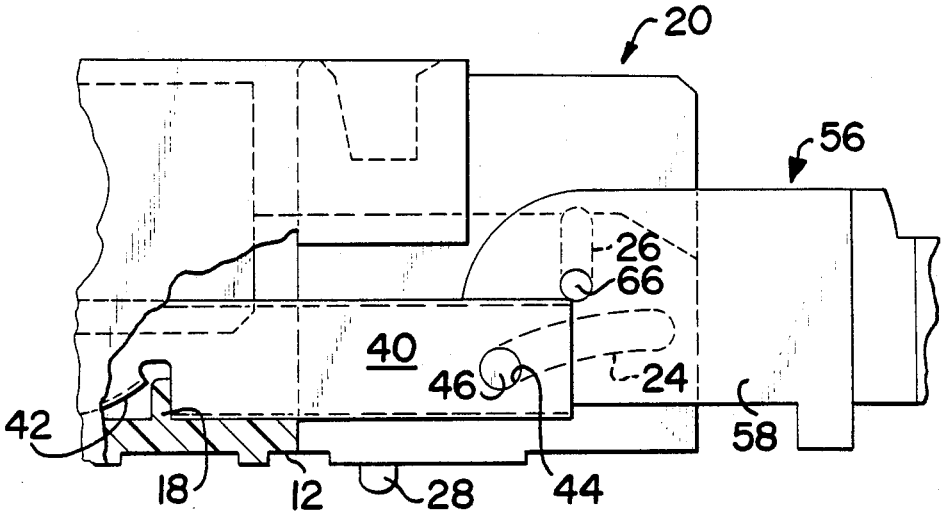
FIG. 2 is a side view showing the camming means in the first position.
Figure 3:
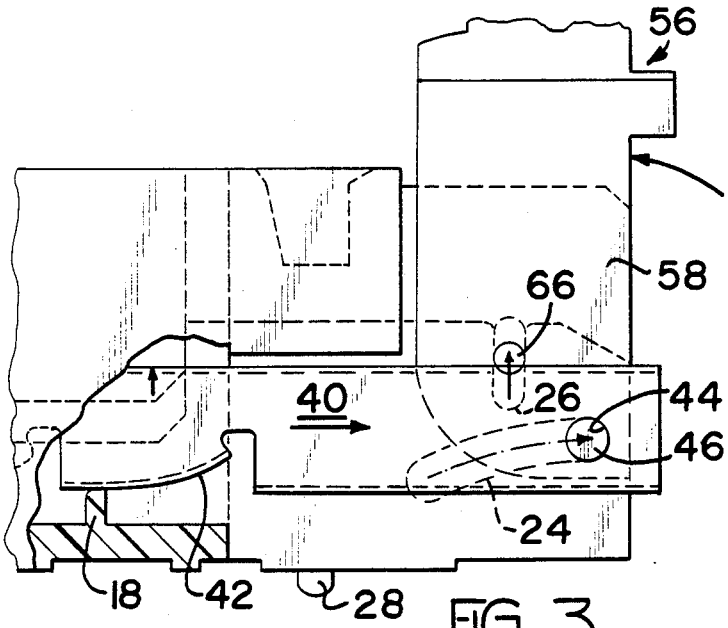
FIG. 3 is a side view, similar to that of FIG. 2, showing the camming means in the second position.
Figure 5:
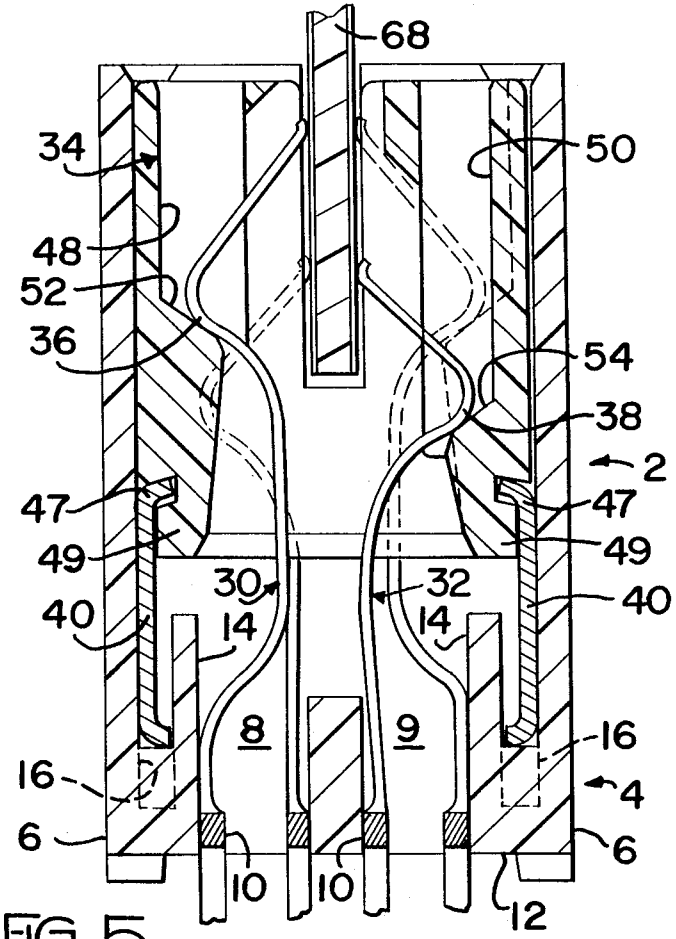
FIG. 5 is a cross-sectional view, similar to that of FIG. 4, showing the contacts of the connector in the closed position.
Figure 4:
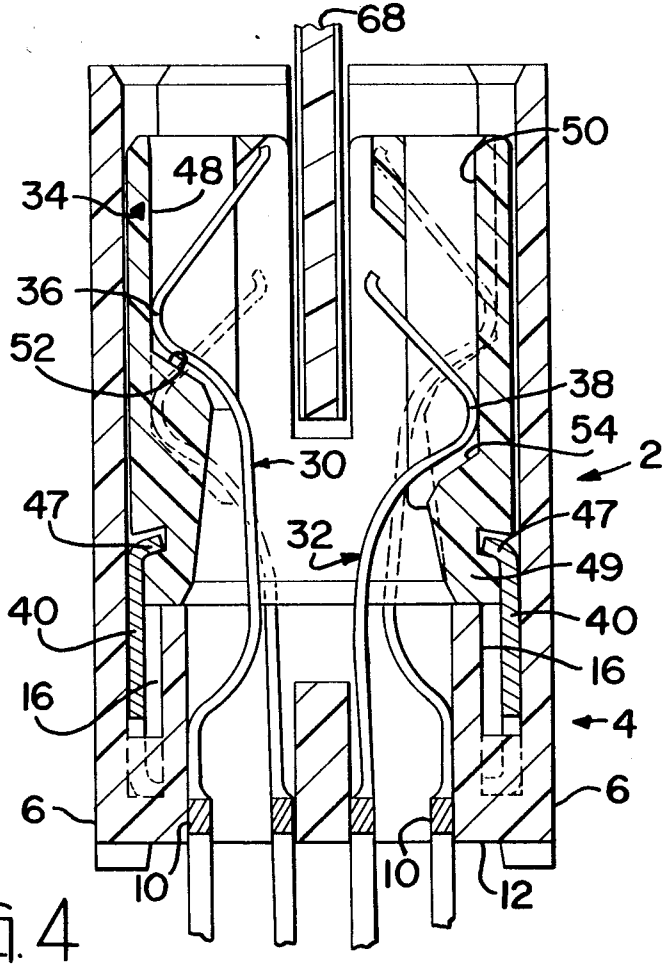
FIG. 4 is a cross-sectional view of the connector looking axially into the connector showing contacts of the connector in the open position.

With reference to FIGS. 4 and 5, the components of connector 2 of the present invention include a lower housing 4, contact elements 30, 32, cam slides 40 and upper housing 34. These several components, along with lever 56 shown in FIGS. 2 and 3, are structured and assembled to provide a card edge connector having a high density of contact elements 30, 32. These elements are cammed into electrical engagement with the conductive traces on a circuit board 68 after it has been inserted into the card-receiving slot in the connector. The housings are made from a suitable insulative material such as a glass-filled plastic sold by Phillips Corporation under the trade name of RYTON R4. The contact elements are preferably stamped and formed on continuous strip with the preferred material being berilium copper and plated with gold over nickel. The camming means are made from any material providing the strength characteristics required to ensure proper operation.

A brief description of the lower housing, the upper housing, and the contact elements are provided below. For a more detailed explanation of the upper housing, the lower housing, and the contact elements refer to U.S. Pat. No. 4,636,021, the entire description of which is hereby incorporated by reference.

Referring to FIGS. 4 and 5, lower housing 4 is configured in the shape of a rectangle, with side walls 6 defining the long sides of the rectangle. A plurality of cavities 8, 9 are spaced down the length of housing 4, such that cavities 8, 9 are positioned between side walls 6. Passages 10 extend through lower housing 4 from cavities 8, 9 downwardly to open out on underside 12.

Side walls 6 of lower housing 4 are spaced from inner walls 14 to define longitudinal slots 16 therebetween. Several cam followers 18 are positioned in and along the slots 16, as shown in FIG. 3.

Figure 1:
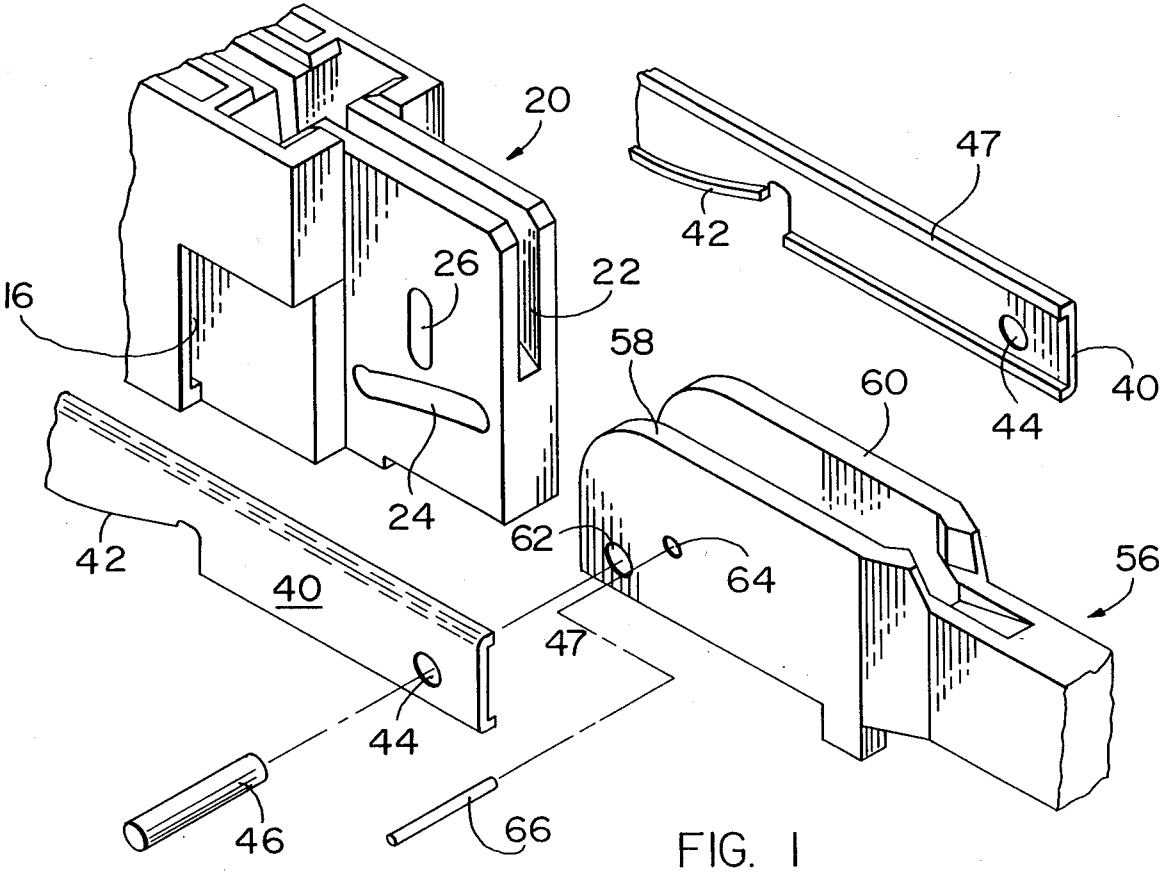
FIG. 1 is an exploded perspective view of a portion of a connector showing the camming means.

Referring to FIG. 1, lever support member 20 is attached to and extends from an end of lower housing 4. Slot 22 extends in and along the top of member 20. Positioned below slot 22 are cam profiles 24, 26 which extend through lever support member, as best shown in FIG. 1.

Cam profile 26 is essentially vertical as shown in FIG. 2 and 3. Cam profile 24 is proximate profile 26 and positioned such that the vertical axis of profile 26 is positioned generally above the horizontal center point of profile 24.

Projection 28 may depend from underside 12 of lower housing 4, as shown in FIGS. 2 and 3. These projections 28 orientate and stabilize connector 2 on the circuit board (not shown), as well as provide the spacing required for washing of the connections.

Contact elements 30, 32 are positioned in respective cavities 8, 9 of lower housing 4 with an upper section of each element 30, 32 extending upwardly into upper housing 34, a retaining section of each contact element 30, 32 positioned in a respective passage 10 and a lower section extending downward from lower housing 4 for insertion into plated-through holes of the circuit board (not shown).

Contact elements 30 differ from elements 32 in that concavo-convex portions 36, 38, which define camming surfaces of each element 30, 32 are horizontally offset relative to the longitudinal axis of the other element. This difference is required so that the two elements 30, 32 can be loaded adjacent each other without interference. Other differences such as length exist but are not significant from the viewpoint of crowding a large number of contact elements 30, 32 in a connector 2.

Cam slides 40, FIG. 1, are elongated members structured to be slidably positioned in slots 16 in lower housing 4. A series of cam ramps 42 are provided along the bottom edge of cam slides 40. Ramps 42 cooperate with cam followers 10 in slots 16 to move cam slides 40 vertically, as will be discussed. Holes 44 are provided proximate an end of slides 40 to receive pins 46 therethrough.

Upper housing 34 is an elongated member which is movably attached to lower housing 4 and which is raised and lowered by operation of cam slides 40. Cam slides 40 are attached to upper housing 34. Projections 47 of cam slides 40 cooperate with projections 49 of housing 34, such that as cam slides 40 are moved in the vertical direction, housing 34 will move accordingly.

Cavities 48, 50 of upper housing 34 are in alignment with respective cavities 8, 9 of lower housing 4. The specific structure of the side walls of cavities 48, 50 can best be seen in the cross-sectional views of FIGS. 4 and 5. The sidewalls of upper housing 34 have beveled cam surfaces 52, 54 located thereon. One such cam surface is located either higher or lower on the wall than the adjacent cam surface, i.e., such that the cam surfaces 53, 54 correspond to the portions 36, 38. Opposed cam surfaces 52, 54 are not alike; i.e., a high cam surface looks directly across cavity 48, 50 at a low cam surface.

Lever 56, as best shown in FIG. 1, has two spaced apart, parallel arms 58, 60. Each arm 58, 60 has two openings 62, 64 provided therein and which extends therethrough. Parallel arms 58, 60 are positioned on either side of lever support member 20.

Lever 56 is maintained in position by pin 66. Pin 66 cooperates with holes 64 of lever 56 and cam profile 26. This allows pin 66 and lever 56 to move in the vertical direction relative to member 20. Pin 46, cooperates with holes 44 of cam slides 40, holes 62 of lever 56, and cam profile 24 of lever support member 20. The configuration of cam profile 24 facilitates the required motion of cam slides 40, as the geometry of the lower surface of cam profile 24 is identical to the motion of cam slides 40.

With the connector in the position shown in FIG. 2 or 5, a printed circuit board 68 may be freely inserted therein. Upon pivoting lever 20 counterclockwise, to the position shown in FIG. 3, cam slides 40 are drawn upward and to the right. The upward motion is facilitated by the cooperation of cam ramps 42 with cam followers 18. As cam slides 40 are moved to the right, cam ramps 42 engage cam followers 18, forcing cam slides 40 upward. The motion causes upper housing 34 to move upward accordingly.

As upper housing 34 is moved, cam surfaces 52, 54 engage portions 36, 38 of elements 30, 32. This forces elements 30, 32 to move inward, and engage conductive traces on board 68 as shown in FIG. 5. Note that contact elements 30 engage the lower traces and the contact elements 32 engage higher traces.

Card 68 may be withdrawn from the connector by pivoting lever 20 clockwise, to the position shown in FIG. 3. This causes the reverse sequence of events as described during the insertion process.

As stated above, opening and closing of the connector is effected by pivoting lever 56 in the counterclockwise direction, to the position shown in FIG. 3. This requires that each element 30, 32 be moved to a corresponding position shown in FIG. 5. Consequently, if a large number of contact elements 30, 32 are present, a large force is required to move contact elements 30, 32 from the position shown in FIG. 4 to the position shown in FIG. 5. As a result, relatively large forces must be supplied by the camming means in order to insure that contact elements 30, 32 are properly positioned.

These forces are generated by the movement of lever 20 from the position shown in FIG. 2 to the position shown in FIG. 3. The forces are then transferred from lever 20 to cam slides 40. This operation requires that the relatively weak pin 66, which acts as a cam follower, be able to withstand relatively large forces. In the prior art, the pivot points could not withstand these forces, and consequently, failure of the camming means occurred frequently. In order to avoid this failure of the camming means, the present invention has cam profiles 24, 26 positioned in lever support member 20.

Cam profiles 24, 26 are configured, as described previously, in such a manner to permit easy sliding of the camming means in lower housing 4. The combination of cam profiles 24, 26 are also configured to slidably absorb the vertical component of the forces which are present in the camming means. In other words, the vertical components of the forces are transferred to member 20, thereby increases the reliability of the camming means. The vertical components are transferred to member 20 which is better able to withstand the forces without failure. This transfer of the vertical components of the forces causes only horizontal forces to be present on cam slides 40, i.e. only forces which act along the longitudinal axis of the cam slides. Consequently, providing cam profiles 24, 26 in member 20 prevents failure of the camming means.

The positioning of cam profiles 24, 26 as shown in FIGS. 1 through 3 is designed to allow the camming means to operate with a minimum amount of pins which act as cam followers.

It should be noted that the camming means described herein can be used with many different type of connectors, and is not limited to the particular connector described.

I claim:

1. A camming means for use with a low insertion force connector having a housing with terminals provided therein, the terminals being moveable from an open position to a closed position, the camming means comprising:

a first slot means provided in a support member, the support member being attached to the housing of the connector;

a second slot means provided in the support member, the second slot means positioned proximate the first slot means;

actuating means having opening means extending therethrough, a first opening means being in alignment with the first slot means, and a second opening means being in alignment with the second slot means, the actuation means being movable from an open position to a closed position;

a plurality of cam slide means extending through slot means provided in the housing of the connector, an end of each cam slide means being positioned proximate the actuating means, the end having an opening extending therethrough, the opening being in alignment with the second opening means and the second slot means, the cam slide means being movable between a first position and a second position, the first position corresponding to the open position of the actuating means and the second position corresponding to the closed position of the actuating means;

pins provided to act as cam followers, a first pin extending through the first slot means and the first opening means, and maintained therein, a second pin extending through the second slot means, the second opening means, and the opening, and maintained therein;

whereby as the actuating means is moved between the open position and the closed position, the cam slide means is forced to move between the first position and the second position, causing the pins to slidably move with respect to the support member.

2. A camming means as set forth in claim 1 wherein each cam slide means has ramps provided on a lower surface thereof, the ramps cooperate with cam followers provided in the slot means of the housing, such that as the cam slide means is moved from the first position to the second position, the ramps engage the cam followers, enabling the cam slide means to move in a direction normal to the longitudinal axis of the cam slide means.

3. A camming means as set forth in claim 2 wherein a second surface of the slide means has a projection extending therefrom, the projection cooperating with a portion of the housing of the connector, such that as the cam slide means are moved the portion of the housing moves accordingly.

4. A camming means as set forth in claim 1 wherein the second slot means is profiled to act as a support means, such that as the actuating means is moved from the open position to the closed position, the second pin forces the cam slide means to move from the first position to the second position, the second slot means is profiled to support the second pin as it moves, thereby the forces generated by the camming means are transferred by the cooperation of the second pin and the second slot means to the support member.

* * * * *